United States Patent [19]

Famolare, Jr.

[11] 4,137,653

[45] Feb. 6, 1979

[54] FOOTWEAR WITH SNORKEL VENTILATION

[75] Inventor: Joseph P. Famolare, Jr., Florence, Italy

[73] Assignee: Famolare, Inc., New York, N.Y.

[21] Appl. No.: 823,960

[22] Filed: Aug. 12, 1977

[51] Int. Cl.[2] ..... A43B 7/06; A43B 13/04

[52] U.S. Cl. ..... 36/3 B; 36/32 R

[58] Field of Search ..... 36/3 R, 3 A, 3 B, 32 R

[56] References Cited

U.S. PATENT DOCUMENTS

| | | | |
|---|---|---|---|
| 3,044,188 | 7/1962 | Evangelista | 36/3 R |
| 3,060,599 | 10/1962 | Okuyama | 36/3 R |
| 3,331,146 | 7/1967 | Karras | 36/3 R |
| 4,000,566 | 1/1977 | Famolare | 36/3 B |

*Primary Examiner*—Patrick D. Lawson

*Attorney, Agent, or Firm*—Mandeville and Schweitzer

[57] ABSTRACT

A hiking or military boot or shoe is provided with a sole formed with a plurality of internal passages which lighten the sole, enhance the flexibility of the sole and provide a portion of a shoe ventilation system. Included is a snorkel arrangement connected to the internal passages to ventilate the sole, with the outlet therefor at an elevated level to prevent moisture from entering the shoe. Preferably, the footwear is comprised of a moisture and air impervious material.

1 Claim, 5 Drawing Figures

FOOTWEAR WITH SNORKEL VENTILATION

BACKGROUND AND STATEMENT OF THE INVENTION

This invention relates to heavy duty type footwear, preferably in the form of a high top military or hiking boot for use in traversing rough terrain. As such, the footwear of the invention may be comprised of moisture impervious material, and so constructed to prevent entry of moisture into the shoe or boot. Of course, with such an arrangement, the wearer may traverse rough terrain and walk through shallow puddles and streams without exposing the feet to moisture. However, one of the drawbacks to heavy duty footwear in general, and moisture impervious footwear in particular is the fact that it does not "breathe" so that the user's feet have a tendency to become overheated and to perspire, particularly since such footwear is usually worn in conjunction with heavy stockings.

With this invention, however, a ventilation system is provided which allows complete and continuous bidirectional flow of air into and out of the upper of the footwear without allowing the ingress of moisture. This is achieved by providing a substantially solid sole or unit bottom for the shoe or boot formed with a plurality of interconnected, integral, internal passages. The passages are, in turn, connected to a plurality of vent holes in the upper surface of the sole or unit bottom and/or overlying insole to provide air communication between the upper and the internal passages in the sole.

In addition, a vertical, elongated vent tube or "snorkel" is provided which is connected to the internal passages of the sole to provide continuous air communication and circulation between the foot cavity and the atmosphere. The snorkel tube is provided with an outlet raised from the ground surface to a point where it is spaced a substantial and safe distance above ground level.

As stated above, although the invention is not so limited, preferably the shoe of the invention is in the form of a high topped boot in order to protect the ankles of the wearer. Furthermore, preferably the sole is in the form of a solid wedge with a contoured "orthopedic" upper surface to enhance the comfort of the wearer and to provide substantial support during long treks over rough terrain. Preferably, the bottom surface of the sole of the shoe of the invention includes raised areas in the toe and heel in order to enhance the striding action of the wearer, and the sole preferably includes integral lugs spaced along the side and bottom surfaces in order to provide traction in rough terrain.

Other objects and advantages of the footwear of the invention will be apparent from the following detailed description in which a military or hiking boot is described illustrating the various detailed aspects of the invention.

DETAILED DESCRIPTION OF THE INVENTION

Figure 1:
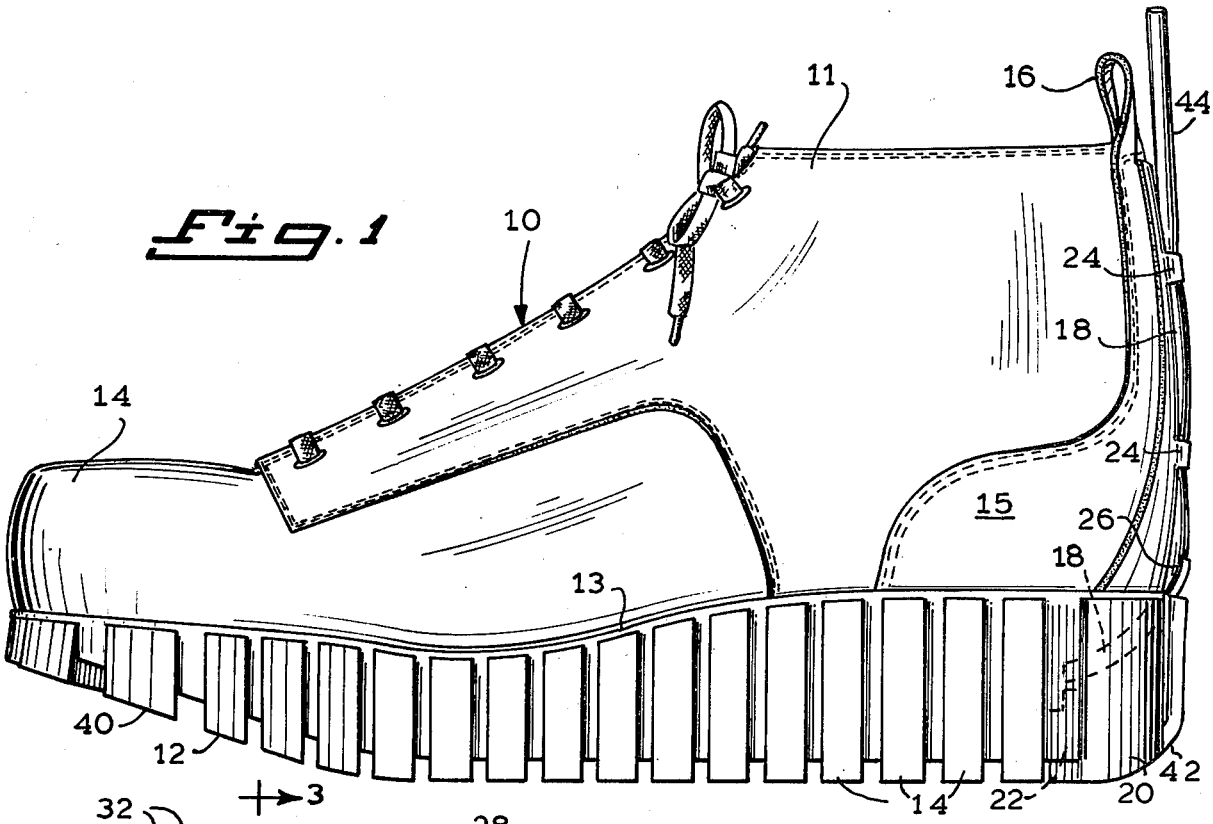
FIG. 1 is a side elevational view of a hiking or military boot embodying aspects of the invention.

Referring to the drawings in which like references refer to like parts throughout the several views thereof, FIG. 1 shows a military boot designated generally 10 with an upper 11 connected to a sole 12. Preferably, the toe 14 of upper 11 is reinforced to protect the toes of the wearer with the heel 15 including a reinforced stitched panel with an integral sling 16 for storing the shoes or boots.

As illustrated in FIG. 1, the sole 12 is formed with a plurality of spaced integral lugs 14 along the side and bottom surfaces thereof in order to provide increased traction for the wearer. Moreover, the sole 12 is formed with a contoured upper surface 13 to enhance the comfort of the wearer. In addition, sole 12 includes raised or curved areas 40, 42 at the bottom of the toe and heel portions, respectively, to enhance the stride of the wearer.

In accordance with the invention, the footwear of the invention includes a snorkel tube 18 extending along the back of the boot in the heel area which provides air ventilation to the internal cavities of the sole 12. As shown in FIG. 1, the air vent tube 18 is supported in the heel area by a plurality of spaced integral brackets 24 for holding the air vent tube 18 against the heel 15 of the boot or shoe. In addition, a protective flap 26 integral with the rear end of sole 12 protects the air vent tube in the vicinity of the heel.

Figure 2:
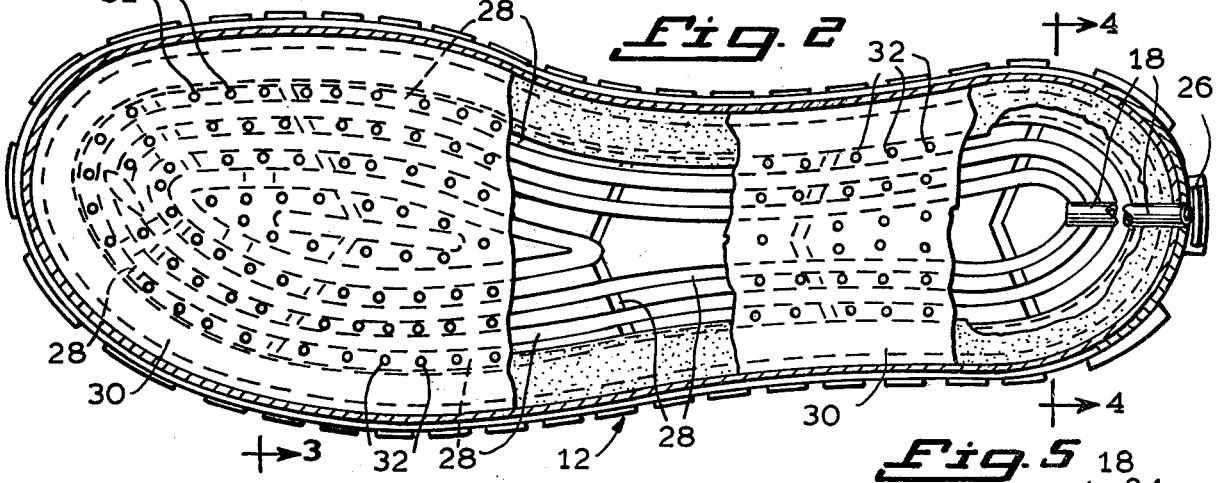
FIG. 2 is a top plan view of the sole of FIG. 1, with parts broken away for clarity.
Figure 3:
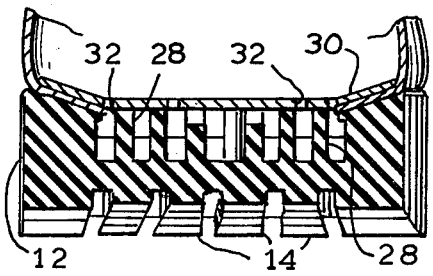
FIG. 3 is a view taken in cross-section along lines 3—3 of FIG. 2.
Figure 4:
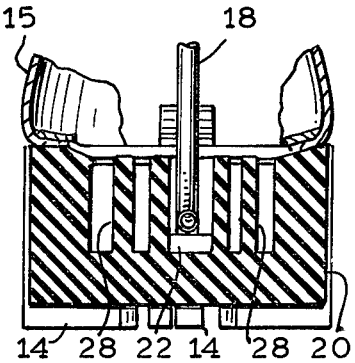
FIG. 4 is a view taken in cross-section along lines 4—4 of FIG. 2.
Figure 5:
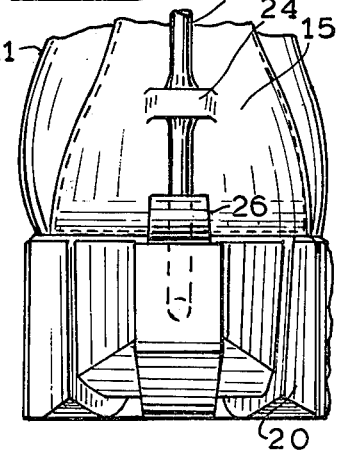
FIG. 5 is an end elevational view of a portion of the boot shown in FIG. 1 as seen from the right hand end thereof.

Referring now to FIG. 2, the sole 12 is formed with a plurality of longitudinally and transversely extending passages 28 in flow communication with each other and in flow communication with an air manifold 22 which in turn is connected to the lower end of the snorkel tube 18. In addition, an insole 30 is cemented in place over the top of sole 12, which insole includes a plurality of air vents 32 for providing communication between the passages 28 in the sole and the foot cavity within the upper 11 of the boot. Thus, there is complete air circulation between the foot cavity of the boot and the raised outlet 44 of the air vent tube 18. As illustrated in FIG. 1, the top 44 of air vent tube 14 is elevated substantially above ground level to prevent the entry of moisture into the foot cavity of the boot.

Thus, as will be understood, once the show is worn and striding action takes place, movement of the foot away from the top surface of the sole causes a partial vacuum to form between the foot and the insole 30. Because of this, air is drawn through air vent tube 18 into the internal passages of the sole and from there through the openings 32 in insole 30 into the foot cavity itself. Subsequently, when the foot moves downwardly against the surface 30, air is forced in a reversed direction through the internal cavities 28 in the sole and out through the air vent 18. this constant circulation, i.e. "breathing" of air provides substantial ventilation of the foot cavity of the boot even though the boot itself is comprised of non-porous materials which do not "breathe". Therefore, the comfort of the wearer is increased substantially not only by the reduction of the temperature level in the foot cavity but by the reduction in perspiration of the feet of the wearer.

Thus, in accordance herewith, the new boot provides for the constant ventilation and reduced temperature level of heavy duty footwear comprised of materials which are air and moisture impervious so as to improve to a large degree the comfort of the wearer while at the same time providing the desired moisture impervious protection required of military and/or hiking boots. Moreover, for ease of manufacture, the sole of the shoe, in accordance herewith, may be molded in one piece with the internal cavities and passages which form a portion of the ventilation system. Advantageously, the internal cavities inherently reduce the quantity of material in the substantially solid sole so as to reduce the overall weight of the footwear, while increasing the flexibility of the sole to enhance the stride and comfort of the wearer.

While the footwear herein disclosed forms a preferred embodiment of this invention, it is not limited to the specific boot illustrated, and changes may be made therein without departing from the scope of the invention, as defined in the appended claims.

I claim:

1. A snorkel shoe construction comprising (a) a molded unit sole having top, side and bottom surfaces, (b) a plurality of interconnected passages formed at said top surfaces, (c) a manifold formed in said sole and communicating with said passages, (d) a tread means formed at said bottom surfaces, (e) an insole having perforations registered with said passages at said top surfaces, (f) a foot enclosing upper secured to said unit sole about the periphery thereof, (g) a snorkel tube anchored in said manifold and extending perpendicularly upwardly and outwardly along a vertical centerline of said upper, said upper and said sole being comprised of moisture and air impervious materials, (h) said snorkel tube extending along said centerline and being supported in direct contact with rear surface portions of said upper, and (i) said rear surface portions of said upper including a plurality of slits defining spaced integral straps for securing said snorkel tube along said centerline and in supportive contact with said upper.

* * * * *